United States Patent [19]

Anderson

[11] Patent Number: 4,627,702

[45] Date of Patent: Dec. 9, 1986

[54] WIDE BELT TRACKING METHOD AND APPARATUS

[75] Inventor: Carl P. Anderson, Menlo Park, Calif.

[73] Assignees: Ricoh Systems, Inc., San Jose, Calif.; Ricoh Company, Ltd., Tokyo, Japan

[21] Appl. No.: 753,045

[22] Filed: Jul. 2, 1985

Related U.S. Application Data

[63] Continuation of Ser. No. 586,028, Mar. 5, 1984, abandoned.

[51] Int. Cl.[4] ..... G03G 21/00

[52] U.S. Cl. ..... 355/3 BE; 198/835; 474/191

[58] Field of Search ..... 355/3 BE, 3 R, 16; 198/835, 840; 271/275, 198; 474/151, 187, 191

[56] References Cited

U.S. PATENT DOCUMENTS

| | | | |
|---|---|---|---|
| 3,308,929 | 3/1967 | Shriver | 198/840 |
| 4,027,966 | 6/1977 | Jordan | 355/16 |
| 4,174,171 | 11/1979 | Hamaker et al. | 355/3 BE |
| 4,225,036 | 9/1980 | Michael | 198/840 |
| 4,421,228 | 12/1983 | Marsiglio et al. | 198/840 X |

FOREIGN PATENT DOCUMENTS

| | | | |
|---|---|---|---|
| 177298 | 1/1954 | Fed. Rep. of Germany | 474/191 |

*Primary Examiner*—R. L. Moses

*Attorney, Agent, or Firm*—Flehr, Hohbach, Test, Albritton & Herbert

[57] ABSTRACT

A self tracking web drive is provided wherein the roller with the friction drive in the center decouples all but a very limited width portion of the belt from the roller. By doing this, the flanges on a second roller cause the belt creep direction to reverse relative to the central high friction drive and move in the opposite direction.

Depending on the alignment of the roller axes, the belt will either walk slowly to one side, then to the other, or to walk to one side, retreat and gradually self-adjust to track close to the flange or just off it.

In fact, a thin driving high-friction area on one roll reduces the contact width between roller and belt and thereby tricks the wide belt into acting as if the width to pulley spacing was 10:1 or greater and becoming self tracking.

13 Claims, 2 Drawing Figures

WIDE BELT TRACKING METHOD AND APPARATUS

This application is a continuation of U.S. application Ser. No. 586,028, filed Mar. 5, 1984 now abandoned.

This invention relates generally to an electrophotographic copying apparatus in which electrically charged toner of one polarity is transferred from an oppositely charged electrostatic image to the front side of a blank sheet for transforming the sheet into an intended copy, and more particularly to an improved automatic tracking roller assembly for a belt type electrophotographic copying machine.

This invention is directed to an improved belt conveyor or belt drive system, and particularly a belt drive system adapted to support an endless belt which moves past various work stations around the belt drive system. The belt assembly of the present invention is particularly adapted for use in electrophotographic copying apparatus.

In present day electrophotographic copying and reproduction machines, a typical photoconductive device comprises a drum which rotates in timed relationship to a plurality of processing stations. However, a limiting feature in such a machine is that the use of the drum imposes the requirement that the image to which the photoconductive drum is to be exposed must be illuminated in a timed relationship to the rotation of the drum. That is, in systems using a drum, copies are producted by forming the electrostatic latent image from a given master as the master is illuminated by moving a light across it. Thereafter, the latent image formed is developed by toner particles, specifically electrically charged heat fusible particles which are applied to the image bearing surface and held to the latent image by electrostatic attraction. The photoconductive surface together with the rotating surface of a transfer drum defines a transfer nip; in this nip; the applied toner particles are transferred to a sheet of blank paper, and fused thereon for transforming the sheet into a permanent copy.

As already noted, in such an apparatus, where an electrophotographic drum is used, the master must be illuminated as the drum rotates past an image forming station. As demands for fast copying have come about, such copying machines have been modified to provide for flash exposure of the document, exposing the document in a single instant and forming a latent image on a moving photoconductor material which is flat at the instant of exposure.

In order to make such an apparatus useful, the photoconductive web or the photoconductive portion of a moving web must be movable from one work station to another, i.e., to the toner developing station and the image transfer station, while remaining precisely laterally positioned on the rollers. Any lateral displacement of the web on the rollers will result in displacement of the image on the blank paper, losing portions of the image and resulting in a nonfunctional machine.

It is also necessary that the web be capable of relatively high speeds of movement across the rollers as the objective of using such a web is to provide increased copying speeds.

A further objective of the present invention is to provide a web apparatus which minimizes wear on the web, so that the maintenance is reduced, as maintenance costs are a key factor in machine selection and utilization.

It is therefore a principal object of the present invention to provide apparatus for moving an endless web from one station to another while minimizing lateral displacement of the web on the rollers.

It is another objective of the present invention to provide for minimum wear on the endless web while allowing unimpeded movement of the web or belt from station to station.

Another objective of this invention is to provide means for supporting a relatively delicate photoconductive web comprising an expensive, easily damaged surface material.

Another objective of the invention is to provide a means for moving the endless web or belt, while allowing for easy removal of the belt and substitution of another belt.

Previous efforts have been made to design automatic web tracking systems. However, it is necessary if crown rollers, bow rollers, or other auto tracking systems are to be employed, that the width of the belt be small compared to the distance between the pulley. This is almost never the case in photocopiers.

In actual fact, in a typical photocopier such as the apparatus of the present invention, the roll spacing is of the same order as the width. In addition, the web thickness is usually small in order to have the normal plane reside in or near the surface on which the photoconductor sits.

It has also been found that edge guiding in a conventional system does not work. For this reason, most prior art efforts have some method of tilting one of the rollers to reverse the direction of the creep. For example, the flanges in Marsiglio, U.S. Pat. No. 4,421,228, are merely sensors which detect the creep of the belt and tilt the other roller, causing the creep of the belt to reverse.

A roller with the friction drive in the center decouples all but a very limited width portion of the belt from the roller. By doing this, the flanges on a second roller cause the belt creep direction to reverse relative to the central high friction drive and move in the opposite direction.

Depending on the alignment of the roller axes, the belt will either walk slowly to one side, then to the other, or to walk to one side, retreat and gradually self-adjust to track close to the flange or just off it.

In fact, a thin driving high-friction area on one roll reduces the contact width between roller and belt and thereby tricks the wide belt into acting as if the width to pulley spacing was 10:1 or greater and becoming self tracking.

More particularly, the self-tracking belt of this invention includes at least a pair of rollers over which the endless belt rotates. To provide the driving force to the belt, a narrow soft frictional surface is provided in the center of the driving roll, equidistant from the ends of the roll and embedded in its periphery. The frictional surface contacts the rear surface of the belt to be driven, and by frictional force drives the belt forward. This narrow surface effectively decouples most of the width of the belt from the driving roller, so that the belt behaves in tracking as though it were very narrow. No flanges are necessary on this driving roller to maintain the belt centered on the roller. The endless belt passes over a second non-driven roller which does have flanges on the end of the roller. By providing such flanges, e.g., on the first roll upward within the copying machine of the drive roll, axial or lateral movement and flange creep of the belt is minimized, and the belt stabilizes to avoid lateral creep.

By having a minimum coefficient of friction between the belt and all rolls over which the belt travels (except where the frictional tire contacts the belt), the lateral force generated by any tendency of the belt to move laterally is kept at a value far below the mechanical strength and abrasion durability of the edges of the belt which may come in contact with the flanges on the roller.

If it is desired to provide tension on the belt, a separate tensioning roller may be utilized to eliminate slack in the belt.

In an alternative embodiment, where it is desirable to have no tension in the belt and the outside surface of the belt will permit it, pressure can be applied over the center of the narrow tire on the driving roll by a narrow or crowned roller which is aligned with the frictional tire. Pressure is applied to the outside of the belt by appropriate spring tensioning of the narrow crowned tire.

These and other advantages as defined above for the present invention will be more fully explained by reference to the attached drawings, in which.

Figure 1:
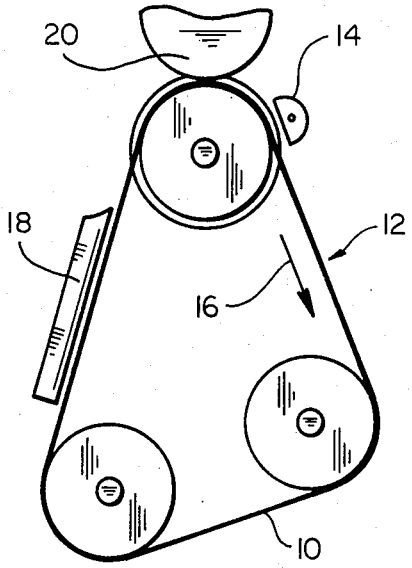
FIG. 1 is a schematic outline of the endless belt having a photoconductive portion designed to be used in connection with an electrophotographic copying machine.

A general understanding of the operation of the electrophotographic copying machine in which this invention is particularly useful may be had by reference to FIG. 1. As noted above, as in all electrophotographic copying systems, a light image of a document to be reproduced is projected onto the sensitized portion of a photoconductive surface to form an electrostatic latent image. Thereafter, the latent image is developed with an oppositely charged developing material to form a powder image, corresponding to the latent image. The powder image is then electrostatically transferred to a support surface such as a blank sheet of paper to which it may be fused by a fusing device whereby the powder image is permanently adhered to the blank paper, creating the desired copy.

In the machine illustrated in FIG. 1, an illumination system not shown flashes light upon the original, causing light rays corresponding to the image to be flashed upon the photoconductive surface of the belt 10 at an imaging station 12. The belt surface that intercepts the light rays comprises a layer of photoconductive material such as selenium that has been sensitized prior to exposure by a charging corona device such as generally indicated at 14. As the belt continues its movement in the direction of the arrow 16, it passes through a developing station indicated generally at 18 at which oppositely charged toner is brought in contact with the latent image on the surface of the belt. The toner particles in the development material are deposited on and attracted to the belt surface by virtue of the fact that the heat fusible toner is charged to a polarity opposite that of the latent image. Thus, as the image-bearing portion of the belt moves through the developing station, the toner is held there by electrostatic attraction.

The developed electrostatic image is then transported by the belt to a transfer station 20 where a sheet of copy paper moving in synchronism with the belt is brought into contact with the developed image. This accomplishes transfer of the toner particles representing the developed image from the belt to the paper.

After the sheet has moved through the transfer nip defined at the transfer station 20, it is conveyed to a fuser assembly (not shown) where the developed and transferred powder image on the sheet material is permanently fixed; meanwhile, the latent image on the belt surface is discharged.

It is apparent from the description given relative to FIG. 1 that it is essential to successful operation of the system that the belt 10 be maintained in proper alignment over each of the rollers, without unexpected lateral movement upon the rollers; that it be capable of movement at relatively high speeds in order to provide for high speeds of copying; and that slippage be kept to a minimum, so that the photoconductive surface of the belt receives the exposure and is kept in timing with the light flashes which form the latent image at the exposure station 12.

Figure 2:
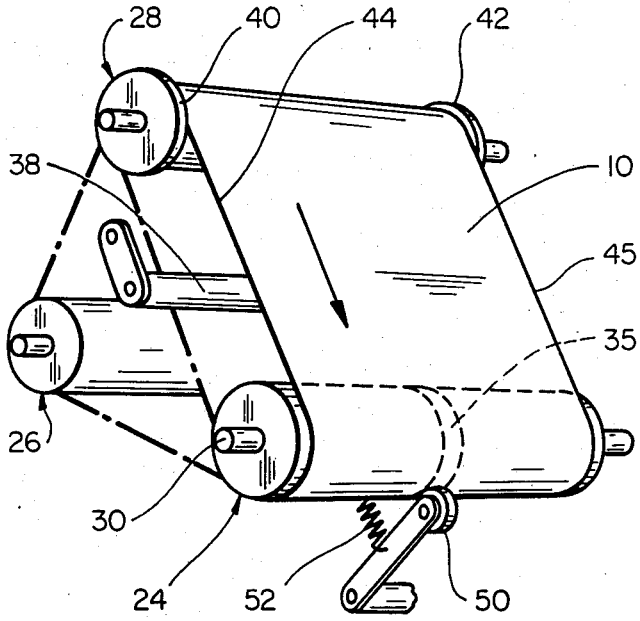
FIG. 2 is a perspective view of an embodiment of the belt driving mechanism of this invention, including a showing of both the tensioning means, and the pressure applying roller which has utility in certain systems.

FIG. 2 shows a simple, inexpensive and reliable method of friction driving a non-elastic belt with or without tension over two or more rolls. Lateral creep of the web or belt is kept to a minimum, or avoided entirely, while the belt is driven at a relatively high rate of speed. It can be seen that in the exemplary system three rollers 24, 26, 28 are provided. However, it can also been seen and is shown by dotted line that the roller 26 is optional, and may be omitted. It is only essential that the axes of all the rollers over which the web is to pass are in parallel alignment in order to prevent distortion of the web or belt. In this exemplary embodiment, driving means are provided coupled to the axis 30 of the roller 24. Such driving means are well known in the copying machine art and are disclosed, for example, in U.S. Pat. No. 3,636,323, dated Oct. 27, 1970.

An important distinction between such previous belt drive means and that utilized in the present invention lies in the fact that the surface of each of the rollers 24, 28 is selected to provide a minimum coefficient of friction between the surface of the roll and the belt 10. The friction to drive the belt forward is provided by a narrow frictional surface 35 located substantially equidistant from the ends of the driving roller 24. This frictional surface, which for example may comprise a narrow soft rubber tire embedded in the periphery of the roller 24, contacts the inner surface of the belt or web 10, and carries it forward.

In circumstances where it is believed necessary to have tension applied to the belt, such tension may be applied either by stretching the web over a third optional roller 26; or alternatively by applying a tension through a narrower, swinging roller 38 whose axis is parallel to the other two rollers 24, 28 in the system. By allowing for rotation of the movable tension applying roller 28, removal of the belt is significantly simplified in cases where it is desired for maintenance or repair.

In order to insure continued lateral alignment of the belt, flanges 40, 42 are provided on roll 28 which is not driven. Ideally, these flanges are placed on the first roller upwardly from the driving roller 24 in the copying system. Note that the flanges are on a roller separate from the driving roller. The flanges 40, 42 on the second roller 28 allow the belt to track to one side, hit the flange and form a slight skew with the driving ring 35. When this occurs, the ring tracking error reverses and the belt 10 moves away from the flange.

By application of the driving force at the center of the driving roll to the rear of the driven belt, minimal lateral displacement of the belt during use of the belt is achieved. A minimum coefficient of friction should exist between the belt and all rolls over which the belt travels except where the tire 35 contacts the rear surface of the belt. In this case, the lateral force generated by the belt's known tendency to off track is kept at a value much below the mechanical strength and abrasion durability of the edges 44, 45 of the belt which comes in contact with the flanges 40, 42.

The thin driving high friction area on one roll tricks the wide belt into acting as if the width to pulley ratio was 10:1 or greater, and the pulley becomes self tracking.

By decoupling all but a small portion the belt 12 from the drive roller 24 with the friction drive in the center, the flanges on the second roller 28 cause the belt creep direction to reverse relative to the central high friction drive and move in the opposite direction whenever the belt moves far enough laterally to contact a flange. Depending on the alignment of the roller axes, the belt will either walk slowly to one side then to the other, or walk to one side, retreat and gradually self adjust to track close to the flange or just off it. In either event, the tracking path of the belt is stabilized.

It may be found in certain embodiments that it is desirable to have no tension on the belt, but that the outside surface of the belt will permit having some slight pressure thereon. In this case, a free turning roller 50 may be provided biased against the center of the driving roll 24, specifically at the point where the narrow frictional surface contacts the rear of the belt. This narrow crowned roller 50, biased for example by spring means 52 against the surface of the driving roller, consistently applies the driving force to the rear surface of the belt and carries the belt consistently and smoothly forward.

Of course, if tension is applied to the belt, as for example by the tensioning roller 38, then the pressure roller 50 is not needed.

Other modifications to the system of the present invention described with respect to this preferred embodiment may become apparent to a person of skill in the art who has studied the above invention disclosure. Different ways of applying tension to the web 10 may be developed: or more parallel rollers may be added. Therefore, the scope of the present invention is intended to be limited only by the following claims.

What is claimed:

1. A belt assembly for supporting an endless belt having an electrophotographic region movable through a plurality of electrophotographic processing stations arranged around the assembly including at least two rollers having parallel axes for carrying said belt, one of said rollers having flanges for centrally positioning said belt, drive means connected to a second one of said rollers for moving said belt, said belt moving roller have a single narrow frictional surface at the center of said second roller functioning as a pulley for movably engaging said belt to decouple the remaining width of the belt from the drive roller surface, the ratio of the width of said narrow frictional surface to the width of said one roller with flanges defining a width to pulley spacing of 10:1.

2. An assembly as claimed in claim 1 further comprising means for applying tension to said belt to increase the driving force on said belt.

3. An assembly as claimed in claim 1 further comprising a roller positioned to press against the outside surface of said belt at a point opposite the driving surface of said second belt carrying roller.

4. An assembly as claimed in claim 1 wherein said narrow frictional surface comprises rubber-embedded in the periphery of said roller.

5. An assembly as claimed in claim 1 further comprising a third roller for applying tension to said belt.

6. In an electrophotographic copying apparatus in which electrically charged toner of one polarity is transferred from an oppositely electrically charged surface of a belt carried on at least two rollers and having a photoconductive portion to the front side of a blank sheet for transforming the latter into an intended copy as the back side of the sheet engages the outer surface of a transfer roll positioned adjacent said belt at one of said rollers, the transfer of toner occurring within a transfer nip defined by said photoconductive portion at one of said rollers and said transfer roll, the improvement comprising a first one of said rollers having flanges on the ends thereof for maintaining tracking of said belt, a second one of said rollers having no flanges on the ends thereof, and including means for coupling only a narrow frictional central portion of this surface on the second one of said rollers to said belt, said narrow frictional surface functioning as a pulley for movably engaging the rear surface of said belt for moving said belt over said rollers, the width of said narrow frictional surface to the width of said one roller with flanges defining a flanged roller width to pulley width ratio of 10:1.

7. The improvement of claim 6 wherein said flanged roller is located higher in said electrophotographic copying apparatus than said one roller with a frictional surface.

8. The improvement of claim 6 including driving means for said one roller having a frictional surface, the other of said rollers comprising a driven roller.

9. The improvement of claim 6 further comprising a pressure roller aligned with said narrow frictional surface of said one roller which constitutes said driving roller for applying pressure to the outer surface of said belt, said belt being carried over said rollers in a non-tension mode.

10. The improvement of claim 9 wherein said pressure roller is spring biased against the outer surface of said non-tensioned belt.

11. A belt assembly for supporting an endless belt having an electrophotographic region for movement through a plurality of processing stations means electrophotographic copying machine arranged about the assembly wherein the improvement comprises a first driving roller having a narrow frictional portion centered in a minimum friction surface for carrying said belt, said frictional portion being in contact with the rear surface of said belt and functioning as a pulley against said belt, said narrow surface effectively decoupling all but a small portion of the belt from the roller surface, and a second roller located above said first roller in said copying machine and having flanges on the ends thereof for carrying said belt and maintaining alignment, said roller having a minimum friction surface, the width of said roller with flanges to said narrow frictional driving surface creating a pulley to roller width ratio of 10:1.

12. The improvement of claim 11 further comprising a third roller in contact with the rear surface of said belt and pressed against said rear surface to put tension on said belt as it passes over the first and second rollers.

13. The improvement of claim 11 further comprising a roller pressed against the outer surface of said belt for maintaining the driving force on said belt.

* * * * *